United States Patent [19]

Thomas et al.

[11] 4,371,809

[45] * Feb. 1, 1983

[54] INTEGRAL-SHADOW-GRID CONTROLLED-POROSITY DISPENSER CATHODE

[75] Inventors: Richard E. Thomas, Riverdale, Md.; George A. Haas, Alexandria, Va.; Richard F. Greene, Bethesda, Md.

[73] Assignee: The United States of America as represented by the Secretary of the Navy, Washington, D.C.

[ * ] Notice: The portion of the term of this patent subsequent to Mar. 3, 1998, has been disclaimed.

[21] Appl. No.: 161,183

[22] Filed: Jun. 19, 1980

[51] Int. Cl.[3] ..... H01J 29/46; H01J 19/42

[52] U.S. Cl. ..... 313/449; 313/346 DC

[58] Field of Search ..... 313/348, 4, 101, 800, 313/449

[56] References Cited

U.S. PATENT DOCUMENTS

| | | | |
|---|---|---|---|
| 3,484,645 | 12/1969 | Drees | 313/348 |
| 3,717,503 | 2/1973 | Beggs | 313/346 R |
| 3,818,260 | 6/1974 | Elfe et al. | 313/348 X |
| 3,852,633 | 12/1974 | Hunter | 313/348 X |
| 4,096,406 | 6/1978 | Miram et al. | 313/348 |
| 4,101,800 | 7/1978 | Thomas et al. | 313/346 DC |
| 4,254,357 | 3/1981 | Haas et al. | 313/348 X |

*Primary Examiner*—Robert Segal

*Attorney, Agent, or Firm*—Robert F. Beers; William T. Ellis; Philip Schneider

[57] ABSTRACT

In a controlled-porosity dispenser cathode of the type which has a foil with a plurality of holes covering the emitting material so that emitting material is dispensed through the holes to the electron-emitting surface of the foil and electrons are actually emitted through the holes and a small area surrounding each hole, a non-emitting shadow grid is laid down on the surface of the foil in such a configuration that it does not obstruct any of the emitting holes, has the same shape as the control grid, and is substantially in precise registration with the control grid.

5 Claims, 8 Drawing Figures

INTEGRAL-SHADOW-GRID CONTROLLED-POROSITY DISPENSER CATHODE

BACKGROUND OF THE INVENTION

This invention relates to controlled-porosity dispenser cathodes for electron tubes and especially to a method and means for shadowing the grid of controlled-porosity dispenser cathode tubes so that emitted electrons will not strike the grid.

In many high-power microwave tubes, it is necessary to turn the electron beam on and off by means of a control electrode (grid) spaced very close to the cathode surface. By varying the voltage on this electrode, electron emission from the cathode surface can be modulated. Because of the electrical field configuration in many of these power tubes, it is necessary to operate the control grid at a positive potential with respect to the cathode in order to turn the beam on. In this event, it is necessary to have a shadow grid between the cathode surface and the control grid to prevent excessive electron current from being intercepted by the control grid (see FIG. 1). Excessive current in the control grid circuit requires excessive power capabilities from the control grid power supply. Using present state-of-the-art practice, the control grid/shadow grid combination is achieved in two ways:

(1) A control grid/shadow grid combination is constructed as an integral unit and the unit is spaced as an integral unit and the unit is spaced over the cathode surface, as shown in FIG. 1;

(2) An integral shadow grid is placed directly on the cathode surface, either by making a separate grid structure and laying it on the surface, or by depositing a metallic layer on the cathode surface in a pattern that will permit registry by the separate control grid structure. In this case, the metallic layer on the cathode surface must be of a material that will maintain an electronically non-emitting state when at cathode temperature and when exposed to various emission-enhancing materials evolving from the cathode. There are disadvantages to both these methods.

Method (1) requires a very precisely made assembly spaced very close to the cathode surface. The amount of voltage swing required on the control grid to modulate the beam current increases with increased spacing between the grids and also with the spacing between the grid assembly and the cathode. Increased spacing also limits the speed at which the beam can be turned on and off. Because of differential thermal expansion effects and limitations in the precision of construction methods, reproducibility and stability of spacings is a major problem.

Method (2) is an improved method insofar as it overcomes the spacing problem between the shadow grid and cathode by depositing the shadow grid directly on the cathode. Thus, it gives rise to faster turn on and off characteristics, and less susceptibility to thermal expansion problems. However, having the shadow grid directly in contact with the emitting surface of the cathode and operating essentially at the cathode temperature can cause other problems. For example, such a shadow grid will emit electrons if it cannot maintain a high work function. Other problems include:

a. Most dispenser cathodes are made by sintering a pressed plug of tungsten powder to create a porous matrix which is impregnated with a barium compound. Consequently, the cathode has a textured surface with a random distribution of pores. At cathode operating temperatures, the barium compound migrates out of these pores and normally forms a low-work-function film on the emitting surfaces surrounding the pores. The coating deposited on the shadow grid areas is usually of zirconium or some similar metal from which the barium compound will evaporate readily at normal cathode operating temperatures. However, since the coating is deposited directly on some pore areas of the cathode, some barium compound will evolve directly through defects in the coating and, in some cases, the coating will not adhere well to the nonmetallic material in the pores (see FIG. 2). In both cases, localized sources of emission will result in the shadow grid areas giving rise to undesirable control grid currents.

b. With the currently used random-porosity dispenser cathodes, the shadow grid must be deposited on the cathode surface after the cathode has been impregnated with the barium compound which forms the activating surface layer. Since the cathode is very susceptible to poisoning by foreign materials, care must be taken about the type of environment the cathode is exposed to after impregnation. This limits the methods that can be used to apply the shadow grid material. For example, chemical vapor deposition and electrodeposition techniques, which are often used to deposit uniform well-adhering coatings of refractory materials, cannot be used because of cathode contamination risks.

SUMMARY OF THE INVENTION

Accordingly, an object of the present invention is to provide an integral shadow grid on the surface of a CPD cathode to prevent interception by the control grid of electrons emitted by the cathode, thereby reducing grid power dissipation and electrical impedance of the grid circuit.

The objects of the present invention are accomplished by placing on the emitting surface of a CPD cathode a non-emitting grid which is substantially the exact replica of the control grid and then making sure that the control grid is on registry with the non-emitting grid. The non-emitting grid material is placed on the emitting surface in such a way that none of the emission holes in the surface are covered.

DETAILED DESCRIPTION OF THE INVENTION

Figure 1:
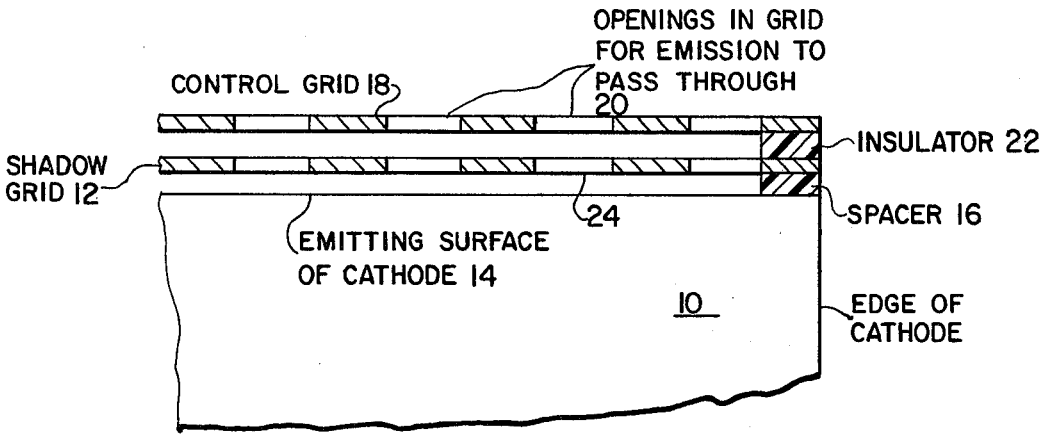
PRIOR ART FIG. 1
FIG. 1 is a partial schematic side view of one type of cathode and control grid structure in a high-power microwave tube, showing the use of a shadow grid.

FIG. 1 shows a type of cathode/shadow grid/control grid assembly which is presently being used in the high-power tube art. A shadow grid 12 is placed close to the emitting surface 14 of the cathode but spaced therefrom by spacers 16. A control grid 18 with openings 20 for electrons to pass through is spaced from the shadow grid by insulators 22. The openings in the shadow grip 24 are in registration with the control-grid openings 20. The disadvantages of this type of shadow grid structure have been mentioned above.

Figure 2:
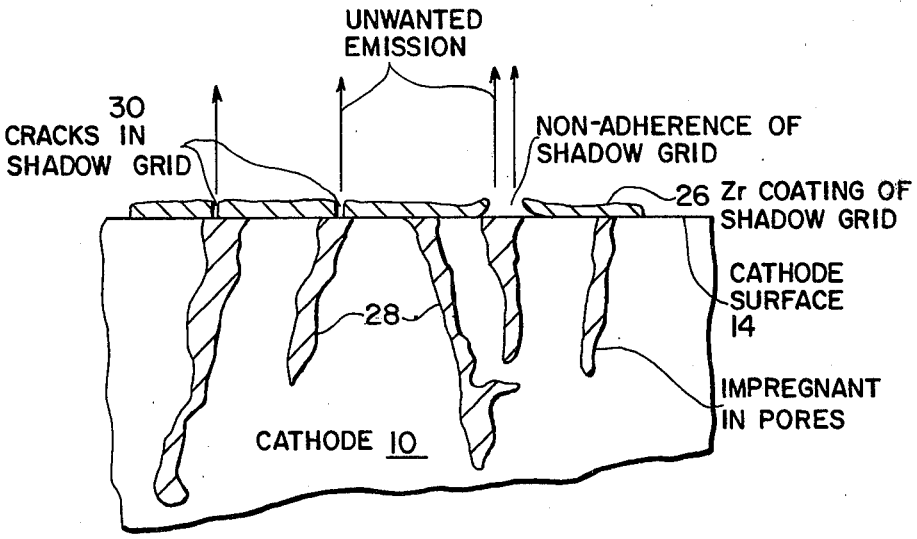
PRIOR ART FIG. 2
FIG. 2 is a schematic view of an impregnated cathode showing defects that may develop in a shadow grid that is deposited directly on the surface of the impregnated material.

The type of cathode structure in which a metallic coating 26 is placed directly on the emitting surface 14 of the cathode 10 is shown in FIG. 2. Emission actually occurs from the impregnant in the pores 28 in the cathode. However, defects 30 in the coating, such as cracks and non-adherent areas, permit unwanted emissions of the electrons.

Figure 3A:
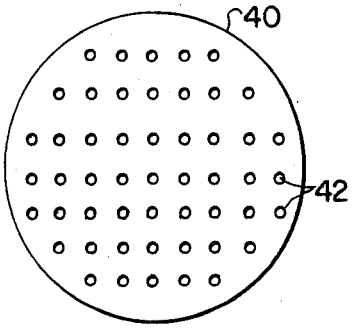
PRIOR ART FIG. 3a
FIGS. 3*a* and *b* are top and side schematic views of a CPD cathode showing its structure.
Figure 3B:
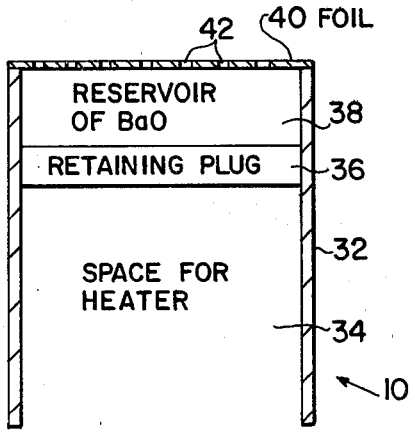
PRIOR ART FIG. 3b

FIGS. 3(*a*) and 3(*b*) show a top view and a side view, respectively, of a CPD cathode 10. Within a container 32 tubular in this case, there is a space 34 for the heater. Near the top there is a retainer plug 36 which holds a reservoir of sintered barium oxide 38. A foil 40, typically 0.001" thick, is placed on top of the reservoir of BaO; the foil 40 is formed with an array of small holes 42 through which emission of electrons from the heated reservoir of BaO occurs. This type of CPD cathode is the subject matter of U.S. Pat. No. 4,101,800.

Figure 4A:
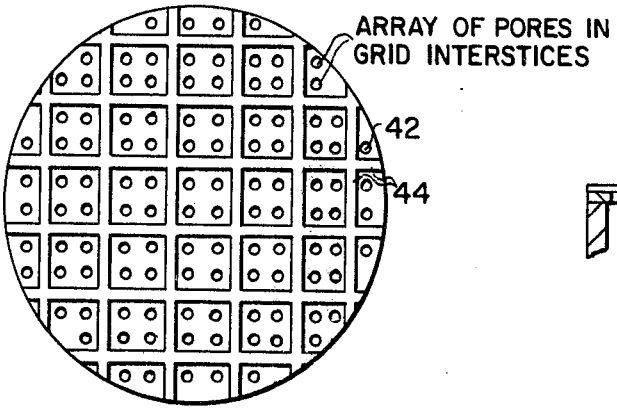
FIGS. 4*a* and *b* are top and side schematic views of an embodiment of the present invention.
Figure 4B:
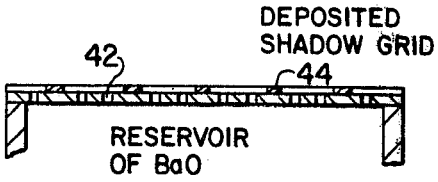

FIGS. 4(*a*) and 4(*b*) show a top view and side view, respectively, of an embodiment of the present invention. The controlled porosity foil, which may be of iridium, tungsten, or other suitable materia. of thicknesses from 0.001" to 0.003", for example, is laid down with its pattern of holes 42. The holes are produced by etching or by chemical vapor deposition techniques. The hole pattern is configured so that there are no holes in regions where the grid 44 is to be. The grid pattern shown is roughly a square pattern, although other configurations may be employed.

After the hole pattern is produced a non-emitting grid material, e.g., zirconium, tantalum, or other suitable material, is deposited on the non-hole areas in the pattern selected for the shadow grid, which should be the exact pattern of the tube's control grid. The deposition can be effected by one of several techniques which are available, viz., vacuum evaporation, sputter deposition, electrolytic deposition, or chemical vapor deposition. Microcircuit photolithography methods are used to mask areas where deposition is not wanted. Typical thicknesses for the shadow grid would be in the range from 0.1 to 5.0 microns.

Figure 5:
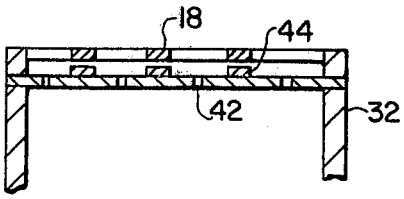
FIG. 5 is a partial schematic view of an embodiment of the present invention showing the control grid structure mounted on the cathode.
Figure 6:
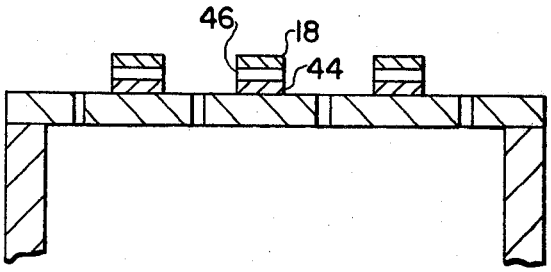
FIG. 6 is a partial schematic view of an embodiment of the present invention showing the control grid structure as a deposit on an insulating coating on the shadow grid.

The control grid can now be mounted as shown in FIG. 5 in registry with the shadow grip or deposited as a film on the shadow grid (as shown in FIG. 6) in registry with the shadow grid. If mounted, it is spaced typically from 0.002 to 0.005 inches from the controlled-porosity surface using an insulated spacer around the edges of the foil 40. It can be brazed to the controlled-porosity surface by metalizing the ends of the insulated spacers. The complete controlled-porosity surface and grid assembly combination may be laser-beam-welded on the end of the cathode sleeve 32. The control grid can also be deposited on the foil 40 by first coating the shadow grid 44 with an insulating material 46 and then depositing the control grid material thereon.

Advantages of the combined integral-grip controlled-porosity cathode surface as compared to the present gridded technology are derived primarily from three main features:

1. The shadow grid is constructed as an integral part of the cathode surface with the following advantages:
   a. Mechanical and thermal stability is improved over shadow grip arrangements where the shadow grid is spaced from the surface.
   b. With the integral shadow grid, less voltage is required on the control grid to modulate the beam current than for the shadow grid which is spaced from the cathode surface. This gives better frequency response and more compact power supply systems.
2. The grid is in registry with areas of the cathode that do not have sources of the cathode activating material (non-pore areas). This gives rise to the following advantages:
   a. No evolution of activating materials through defects in the grid material occurs. The distances required for the activating material to migrate in order to cover the grid surface is larger. This reduces the possibility of grid emission.
   b. Possible contaminating materials in the grid structure that could react with the cathode impregnants are not in direct contact with the impregnant. Reduced possibility of cathode poisoning thus results.
   c. The grid material is deposited only on metallic areas of the cathode surface, and not on impregnant-covered areas. Since metal films do not adhere well to impregnant materials, better adhering films with fewer defects result.
   d. Since the pattern of emitting areas is precisely controlled, problems due to non-uniformities, and lack of reproductibility are eliminated.
3. Grid deposition is done as a part of the fabrication of the controlled-porosity cathode surface itself, and is done independently of the construction of the environment required for deposition of the grid. This leads to the following advantages:
   a. Regardless of the deposition technique, some risk of contamination of the cathode impregnant is involved when conventional cathodes are gridded. The technique disclosed herein minimizes this risk since the impregnant is not exposed to the deposition environment.
   b. With this technique, one has the option of using several alternate methods of grid deposition, as mentioned heretofore. Some of the techniques which have advantages with respect to cost and reliability cannot be used with conventional gridded cathode construction because contamination of the cathode would result.
   c. In the event a poor grid deposition is obtained, the entire cathode assembly is not lost as is the case with the conventional methods. This is a cost-saving feature.

Any grid configurations necessary to give optimum control of frequency and beam modulation characteristics of of beam density profile may be employed; the grid configuration is not limited to the square or rectangular configuration shown in FIG. 4(*a*).

The controlled-porosity cathode surface can be of sufficient thickness (greater than 0.005") to allow impregnation of the plug with the methods ordinarily used with conventional random-porosity dispenser cathodes.

The controlled-porosity cathode surface can be made in the form of a single crystal, optimized for best electron emission density. By having a single-crystal cathode surface, the grid can be deposited epitaxially to provide a single-crystal grid surface whose orientation is optimized to minimize the amount of activating material that will be maintained on the grid surface, thereby minimizing grid emission. The same advantages accrue to a controlled-porosity dispenser cathode surface which is polycrystalline but preferentially oriented for improved emission and reliability properties.

Where there is an advantage is doing so, the cathode can be completely fabricated with an integral shadow grid, and without the control grid. The cathode can then be inserted in an electron gun structure containing the control grid. This could be economical where the cathode is replaced frequently, e.g., in a test situation.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. In a controlled-porosity-dispenser cathode of the type having a foil with a plurality of holes placed on the surface of a reservoir of electron-emitting material so that electron-emitting material is dispensed through the holes to the electron-emitting surface of the foil over a small area surrounding the holes and electrons are emitted from the holes and said small area surrounding the holes, and having a control grid spaced from the foil to control the emission of electrons, the improvement comprising:

an integral shadow grid formed upon the surface of the foil, the grid configuration being such that no holes in the foil are covered by the shadow grid and such that the control grid will be in substantially exact alignment with the shadow grid, the shadow grid material being of a type which does not emit electrons at the operating temperature of the cathode.

2. The improvement of claim 1, wherein the shadow grid material is selected from the group consisting of zirconium and tantalum.

3. The improvement of claim 1, wherein:

said shadow grid is deposited upon the surface of said foil.

4. The improvement of claim 3, wherein:

a coating of insulating material is placed on said shadow grid and said control grid is deposited on said insulating coating.

5. The improvement of claim 1, wherein:

the thickness of said shadow grid is from 0.1 to 5.0 microns.

* * * * *